US006390178B1

(12) United States Patent
Makino

(10) Patent No.: US 6,390,178 B1
(45) Date of Patent: May 21, 2002

(54) METHOD AND SYSTEM FOR A GREEN-SAND MOLDING

(75) Inventor: Hiroyasu Makino, Toyokawa (JP)

(73) Assignee: Sintokogio, Ltd., Aichi Prefecture (JP)

( * ) Notice: Subject to any disclaimer, the term of this patent is extended or adjusted under 35 U.S.C. 154(b) by 0 days.

(21) Appl. No.: 09/344,288

(22) Filed: Jun. 30, 1999

(30) Foreign Application Priority Data

Jul. 1, 1998 (JP) ..... 10-186002

(51) Int. Cl.[7] ..... B22C 9/02
(52) U.S. Cl. ..... 164/456; 164/4.1
(58) Field of Search ..... 164/456, 18, 38, 164/40, 187, 195, 154.1, 155.1, 4.1

(56) References Cited

U.S. PATENT DOCUMENTS 5,333,025 A * 7/1994 Larsen ..... 164/456
5,980,794 A * 11/1999 Stegemann et al. ..... 164/456

FOREIGN PATENT DOCUMENTS

EP 853 993 A1 7/1998 ..... B22C/19/04
JP 10-202344 8/1998

OTHER PUBLICATIONS

"Intelligent System Recognises the Mould", Foundry Trade Journal, vol. 163, No. 3384+Suppl. (Feb. 10, 1989).

* cited by examiner

*Primary Examiner*—Nam Nguyen
*Assistant Examiner*—I.-H. Lin
(74) *Attorney, Agent, or Firm*—Gray, Cary, Ware & Freidenrich LLP

(57) ABSTRACT

A method and system for operating a green-sand molding machine with the aid of a computer is provided. An input interface (2) receives the input data of a user that includes the type of a given green-sand molding process, the design condition of a pattern plate, the physical characteristics of the green sand, and the pressure of squeezing, for the machine (1). A calculating unit (3) calculates the charging of the green sand in a green-sand mold by analyzing the green-sand molding process based on the input data of the user from the input interface (2) before the mold has been actually produced. An output interface (4) provides the calculated results from the calculating unit (3) to the machine (1) so as to make the controlled amount for the machine (1) to follow the results calculated during an actual molding process that is carried out by the machine (1).

9 Claims, 8 Drawing Sheets

METHOD AND SYSTEM FOR A GREEN-SAND MOLDING

FIELD OF THE INVENTION

This invention generally relates to a green-sand molding process. More particularly, this invention relates to a method and system for operating a green-sand molding machine to produce a mold that has the desired charging of green sand.

BACKGROUND OF THE INVENTION

Typically, in a green-sand molding process in, e.g., a green-sand molding machine with a flask, an insufficient charge of green sand in the flask is detected after a mold has been actually produced. Thus, to change or improve its bulk density, many repeated trials for molding have had to be made. Simultaneously, data such as on the configuration of a pattern plate, conditions of molding (e.g., the pressure of the squeezing), and the physical properties of the green sand, have had to be modified. For a particular pattern plate or its varieties that are commonly used, with empirically-accumalated data on the, to same extent an optimum mold is produced.

However, the empirically-accumulated data is of no use for a new application, e.g., for a new pattern plate that has a very different configuration from a common one, or a new molding process, or new green sand that has different physical properties from a common one. Consequently, to obtain the optimum conditions for such a new application, many trials for molding must be carried out, and this takes many hours. Further, when a mold is produced, the influence of bentonite or oolite must be considered, and such an influence cannot be predicted from the ordinary charging of the particles of the green sand.

SUMMARY OF THE INVENTION

The embodiments of the present invention are directed to resolve the above problems.

One object of the invention is to provide a method for operating a given green-sand molding machine with the aid of a computer that produces a mold that has a desired charging of green sand and that requires no actually-produced mold for detecting the charging of the green sand.

Another object of the invention is to provide a system for a green-sand molding process that can determine the desired charging of green sand in a mold to be molded, before it has been actually produced.

In the present invention, the types of green-sand molding processes used in the green-sand molding machine include a molding process by the so-called "jolt squeezing" with a solid material (e.g., a squeezing board), pressurized air or air impulses, and a combination of these processes.

In the present invention, the term "design condition of pattern plate" incorporated in the green-sand molding machine includes items such as the location(s) of vent plug(s), the number of vent plug(s), and the shape or height of a pocket(s).

In the present invention, the term "green-sand mold" generally means a mold in which green sand composed of silica sand, etc. as aggregates, and a binder, e.g., bentonite or oolite, is used.

In the present invention, the term "physical properties of the green sand" of the green sand that is incorporated in the green-sand molding machine generally means properties such as water content, compressive strength, and permeability.

In the present invention, the term "pressure of squeezing" generally means a pressure where the green-sand molding machine presses the green sand within a flask. The pressure of the squeezing generally is caused by a solid material. However, it is to be noted that the pressure of the squeezing also includes a pressure caused by such as air, e.g., shock waves of pressurized air or a blast from an explosion. In this case, the so-called "pressurized-air-applying" or "air blowing"-types of molding processes are used.

In the present invention, analyzing a green-sand molding process includes a finite element method, a finite volume method, differential calculus, and a discrete element method.

DESCRIPTION OF THE PREFERRED EMBODIMENTS

Figure 1:
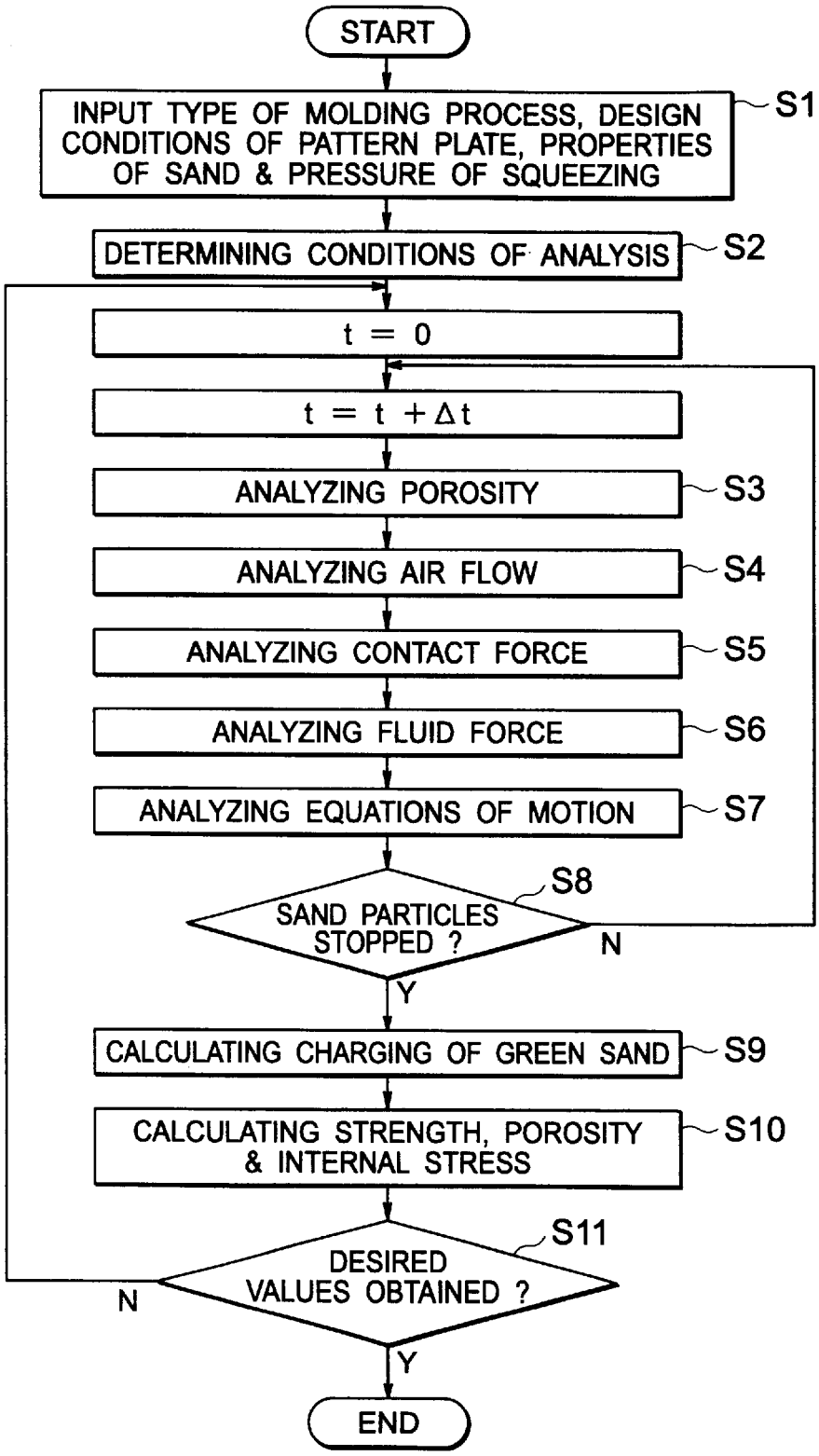
FIG. 1 is a flowchart showing the steps of analyzing a molding process of the present invention.
Figure 2:
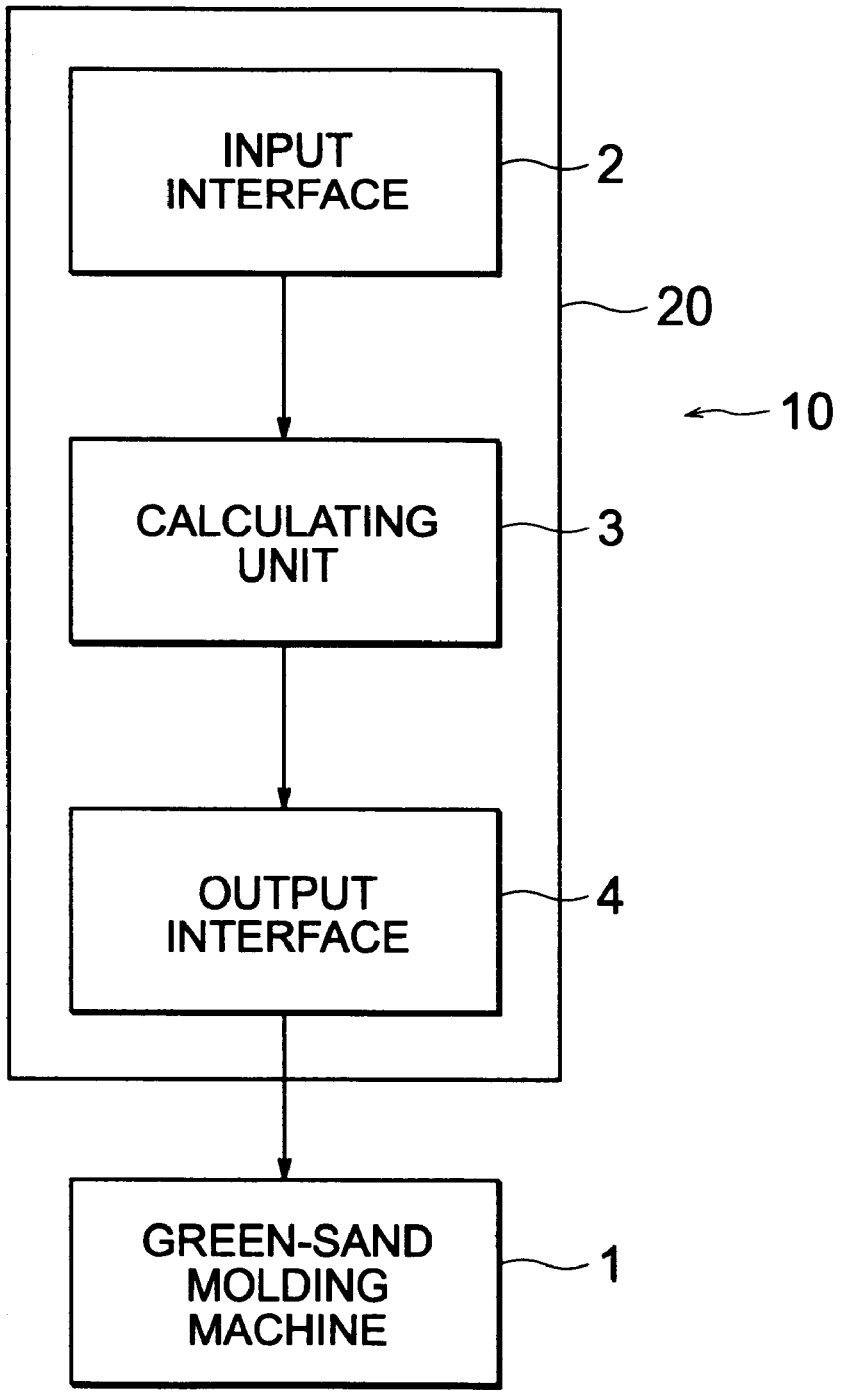
FIG. 2 is a schematic diagram of the system of the present invention.

FIG. 1 shows a flowchart of the steps of the method of the first embodiment of the invention to obtain optimum conditions for operating a green-sand molding machine with the aid of a computer. FIG. 2 shows a system, generally indicated at 10, of the first embodiment of the invention that is carried out in the flowchart of FIG. 1. The system 10 comprises a green-sand molding machine 1 and a computer system, generally indicated by 20.

The computer system 20 comprises an input interface 2, a calculating unit or main unit 3, and an output interface 4. The input interface 2 is coupled to an external input device (not shown) from which an operator can enter data that includes the type of the green-sand molding process, the design conditions of a pattern plate, the physical properties of the green sand, and the pressure of squeezing, for use in the molding machine 1. The external input device may include a keyboard and a mouse.

The calculating unit 3 includes (not shown) a microprocessor unit (MPU), and a memory for storing data input by an operator. The calculating unit 3 is coupled to the input interface 2 for receiving the input data and for calculating the strength of a mold to be molded by means of a green-sand molding analysis process based on the received input data.

The output interface 4 is coupled to the calculating unit 3 for receiving the result of the calculation of the calculating unit 3. The output interface 4 may be coupled to an external output device (not shown), such as a display for presenting the input data and other information concerning the input data obtained from the calculating unit 3. The output interface 4 is also coupled to the molding machine 1. The result of the calculation received by the output interface 4 is provided to the molding machine 1 for controlling it.

Figure 3:
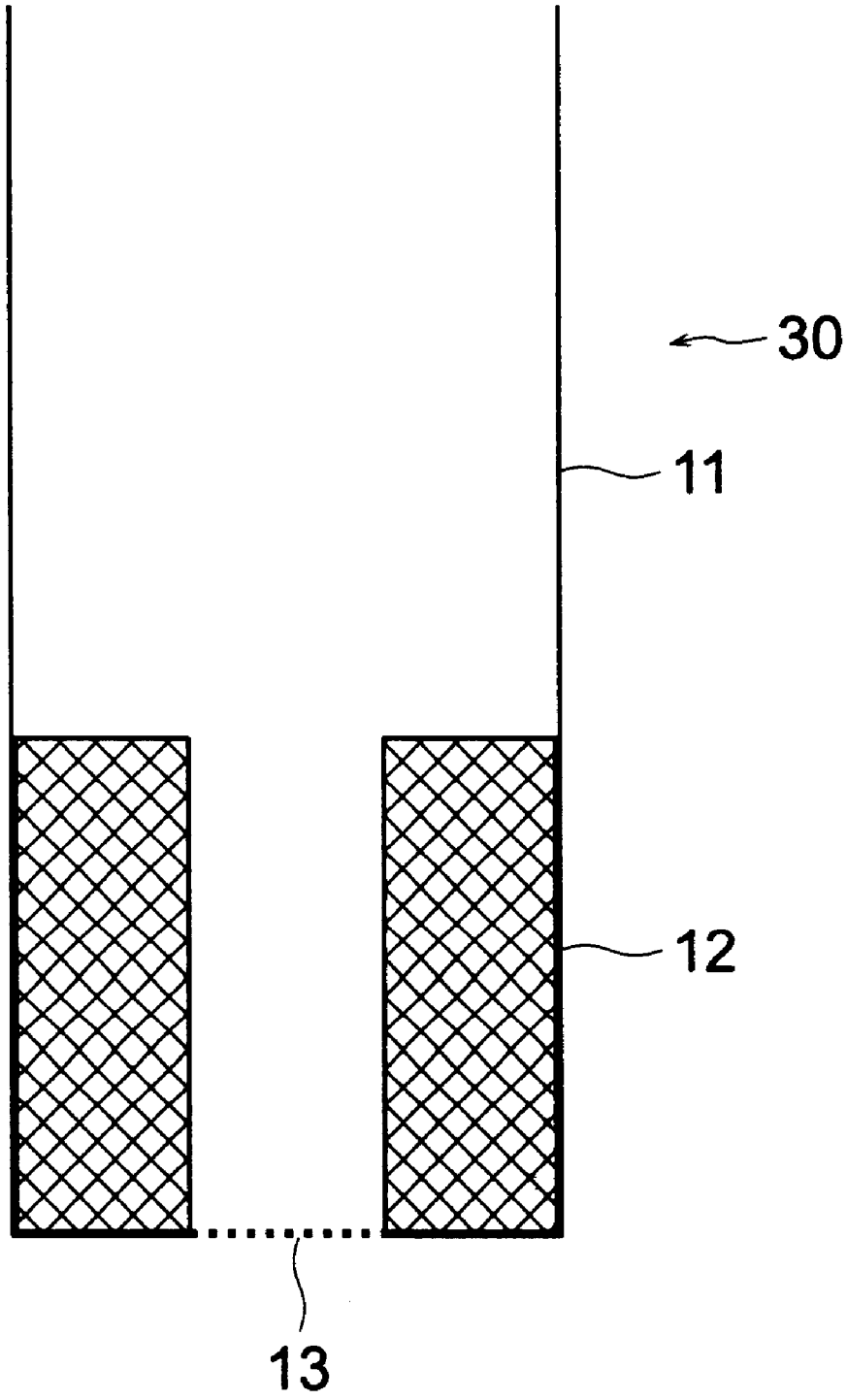
FIG. 3 is a model of a metal flask, pattern, and vent plug that are used in the present invention to make an analysis.

FIG. 3 shows a model 30 to be charged with the green sand by the molding machine 1, as an example. The model has a metal flask 11, one or more patterns 12 attached to the metal flask 11, and one or more vent plugs 13 fitted to the pattern 12.

In this embodiment, the molding machine 1 (FIG. 2) molds a green-sand mold by charging the model 30 (FIG. 3) with the green sand, and contacting the charged green sand by blowing compressed air throughout the sand.

The embodiment, is now explained in relation to the flowchart of FIG. 1. It should be noted that the equations in the following steps are stored in the memory of the calculating unit 3 of the computer system 20 (FIG. 2).

In the first step S1, the operator enters data that is to be set in the molding machine 1 to the input interface 2 of the computer system 20 via the input device. The operator inputs data by the input device, which include the type of the green-sand molding process (it is designated a pressurized-air-applying type in the first embodiment), the design conditions of the pattern plate, the physical properties of the green sand, and the pressure of squeezing.

The input interface 2 provides the data input by the operator to the calculating unit 3 (FIG. 2) of the computer system 20. Then the calculating unit 3 determines the number of elements, depending on the needed degree of precision of the analysis (step S2).

In this case, the dimensions of the metal flask 11 are 250×110×110 (mm), and the dimensions of the pattern 12 are 100×35×110 (mm). For the physical properties of the green sand, the diameter of the particulate element is $2.29\times10^{-4}$ m, the density is 2,500 kg/m$^3$, the friction factor is 0.731, the adhesion force is $3.56\times10^{-2}$m/s$^2$, the restitution coefficient is 0.228, and the form factor is 0.861.

In the second step S2, the diameter of the silica sand to be analyzed is determined such that the entire volume of the silica sand that is used for producing a mold is "maintained." In this case, if the entire volume of the silica sand that is used for producing the mold is divided into 1000 particulate elements, and if each of the elements has the same diameter, it is assumed that the same diameter is the diameter of each particulate element. That is, the volume to be divided into 1000 elements is the same volume of the silica sand that is used for producing the mold.

Similarly, the thickness of the layers of oolite and bentonite to be used in the analysis is determined. In this embodiment, the discrete element method is used. Tis method gives a higher degree of precision for prediction than other methods.

Then, meshes are created for an analysis of the porosity and air flow. The term "meshes" denotes a grid that is necessary for calculations. The values of the velocity and porosity at the grid points are calculated. These meshes are also used for the analysis of the air flow.

The third step S3 is one to analyze the porosity. In this step S3, the volume of the green sand in each mesh and the porosity of each mesh are calculated.

The fourth step S4 is one to analyze the air flow. In this step S4, the velocity of the air flow that is blown into the metal flask 11 by the pressurized air is obtained from a numerical analysis of an equation that considers its pressure loss.

The fifth step S5 is one to analyze the contact force. This analysis calculates the distance of two given particles i,j (not shown) and determines whether they contact each other. If they do, two vectors are defined. One is a normal vector (not shown), starting from the center of the particle i toward the center of the particle j, and the other vector is a tangent vector, which is directed 90 degrees counterclockwise from the normal vector.

Figure 4:
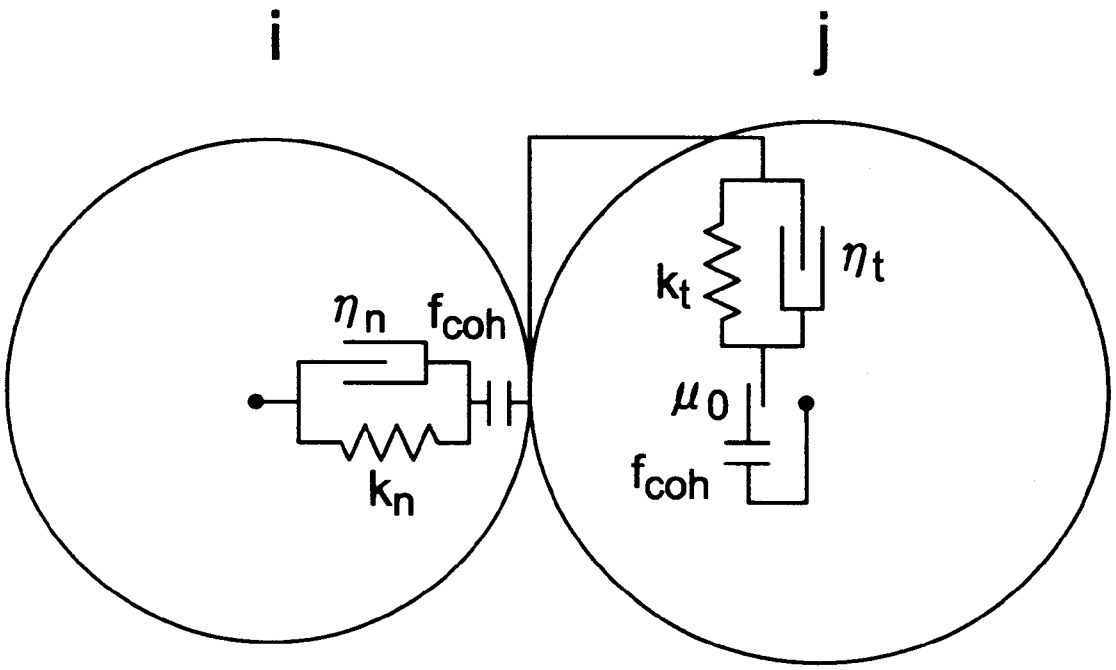
FIG. 4 is a model of sand particles to obtain the force of the contact between the particles.

As in FIG. 4, by providing two contact particles (distinct elements) i,j with virtual springs and dashpots in normal and tangent directions, the force of the contact between the particles i and j is obtained. The force of contact is obtained as a resultant force of normal and tangent components of the force of contact.

In the fifth step S5, first, the normal force of contact is obtained. The relative displacement of the particles i,j during a minute period of time is given by equation (1), using an increment in a spring force and an elastic spring factor (coefficient of a spring) that is proportional to the relative displacement.

$$\Delta e_n = k_n \Delta x_n \tag{1}$$

where, $\Delta x_n$: relative displacement of the particles i,j during a minute period of time $\Delta e_n$: an increment in a spring force $k_n$: an elastic spring factor (coefficient of a spring) that is proportional to the relative displacement.

Further, the dash-pot force is given by equation (2) using a viscid dash-pot (coefficient of viscosity) which is proportional to the rate of the relative displacement.

$$\Delta d_n = \eta_n \Delta \chi_n / \Delta t \tag{2}$$

where, $\Delta d_n$: viscous drag $\eta_n$: a viscid dash-pot (coefficient of viscosity) proportional to the rate of the relative displacement.

The normal spring force and dashpot force of the particle j acting on the particle i at a given time are obtained by equations (3) and (4) respectively.

$$[e_n]_t = [e_n]_{t-\Delta t} + \Delta e_n \tag{3}$$

$$[d_n]_t = \Delta d_n \tag{4}$$

The tangent force of the contact is given by equation (5).

$$[f_n]_t = [e_n]_t + [d_n]_t \tag{5}$$

where, $[f_n]_t$: a normal force of the contact

Accordingly, the force of the contact acting on the particle i at a given time (t) is calculated by considering all forces generated by the contact with other particles.

In the step S5, second, the influences of oolite and bentonite in the tangent component of the force of the contact are considered. In other words, since green sand is comprised of aggregates such as silica sand, etc., plus layers of oolite and bentonite, the respective values of the coefficient of the spring force and the coefficient of the viscosity are selected according to the thickness of the layers relative to a contact depth (relative displacement), as in the following expressions:

$$\text{when } \delta<\delta_b \tag{6}$$

$$k_n=k_{nb} \tag{7}$$

$$\eta_n=\eta_{nb} \tag{8}$$

where, $\delta$: a contact depth (relative displacement)

$\delta_b$: thickness of the layers of oolite and bentonite $k_{nb}$: a spring constant acting in the layers of oolite and bentonite $\eta_{nb}$: a coefficient of viscosity acting in the layers of oolite and bentonite $$\text{when } \delta_b<\delta \tag{9}$$

$$k_n=k_{ns} \tag{10}$$

$$\eta_n=\eta_{ns} \tag{11}$$

where, $k_{ns}$: a spring constant acting in the layer of oolite and bentonite and a silica sand particle $\eta_{ns}$: a coefficient of viscosity acting in the layer of oolite and bentonite and a silica sand particle Since a bond force acts between the green sand particles that are used in this invention, such a bond force or strength between the particles i,j must be considered. When the normal force of the contact is equal to or less than the bond strength, the normal force of the contact is deemed zero.

In step S5, finally, the tangent force of the contact is obtained. Assume that, similar to the normal force of the contact, the spring force of the tangent force of the contact is proportional to the relative displacement, and that the dash-pot force is proportional to the rate of the relative displacement. In this case the tangent force of the contact is given by equation (12).

$$[f_t]_t=[e_t]_t+[d_t]_t \tag{12}$$

Since the contacted sand particles i,j slip therebetween or the sand particle i slips on a wall, the slippage is considered using Coulomb's Law, as follows:

$$\text{when } \|[e_t]_t\|>\mu_0[e_n]_t+f_{\infty h} \tag{13}$$

$$[e_t]_t=(\mu_0[e_n]_t+f_{\infty h})\cdot\text{sign}([e_t]_t) \tag{14}$$

$$[d_t]_t=0 \tag{15}$$

$$\text{when } \|[e_t]_t\|<\mu_0[e_n]_t+f_{\infty h} \tag{16}$$

$$[e_t]_t=[e_t]_{t-\Delta t}+\Delta e_t \tag{17}$$

$$[d_t]_t=\Delta d_t \tag{18}$$

where, $\mu_0$: a coefficient of friction $f_{\infty h}$: bond strength sign (z): represents the positive or negative sign of a variable z.

The sixth step is one to analyze the fluid forces acting on the particles and calcute the forces. These forces are calculated by equation (19).

$$f_d=(1/2)(\rho_s C_D A_s U_i^2) \tag{19}$$

where, $\rho_s$: the density of the fluid $C_D$: the coefficient of reaction $A_s$: the projected area $U_i$: the relative velocity.

When the forces are calculated for an air flow-applying-type molding process, by using the data obtained from the analysis of the air flow in step S4, the relative velocities of the air flow and particles are calculated. When a molding process other than an air flow-applying-type is used, only the velocity of the moving sand particles i is calculated.

The seventh step S7 is one to analyze the equation of motion. In this step, the acceleration caused by the collision or contact of the particles i,j is obtained by equation (20) using the forces acting on the particles, i.e., the forces of the contact, coefficient of reaction, and gravity. Steps S3 to S7 are the steps to analyze the green-sand molding process for determining the degree of charging of green sand in the molding process.

$$\ddot{r}=(1/m)(f_c+f_d)+g \tag{20}$$

where, r: a position vector m: the mass of the particle $f_c$: force of the contact $f_d$: fluid force g: gravitational acceleration $\ddot{r}$: second order differential of r in relation to time.

Also, when the particles collide obliquely (at an angle), rotations are produced. The angular acceleration of the rotations is given by equation (21).

$$\dot{\omega}=T_c/I \tag{21}$$

where, $\omega$: angular velocity $T_c$: torque caused by the contact

I: moment of inertia $\dot{\omega}$: differential of $\omega$ in relation to time.

From the acceleration obtained from the above equation and expressions (22) and (24), the velocity and the position after a minute period of tire are obtained.

$$V=V_0+\ddot{r}\Delta t \tag{22}$$

$$r=r_0+V_0\Delta t+(1/2)\ddot{r}\Delta t^2 \tag{23}$$

$$\omega=\omega_0+\dot{\omega}\Delta t \tag{24}$$

where,

V: the velocity vector $_0$: the value at present $\Delta t$: a minute period of time.

In the eighth step S8, these calculations are repeated until the particles stop moving.

Consequently, in the ninth step S9, the information for charging green sand in the molding process is obtained.

In the tenth step S10, in the calculating unit 3, the CPU reads out from the data the predetermined experimental relationships between the charging of the green sand and the strength or hardness of the green-sand mold, between the charging of the green sand and the porosity of the green-sand mold, and between the charging of the green sand and the internal stress of the green-sand mold. The MPU of calculating unit 3 compares these relationships and the charging of the green sand when the particles stop moving in step S9, then calculates the strength, the porosity, and the internal stress, for the green-sand mold to be molded.

In the eleventh step S11, these calculations are repeated until the desired strength, or the porosity, or the internal stress, or all of then, is obtained, while the condition(s) such as pressure of squeezing is changed.

If the desired strength, porosity, and internal stress are obtained, the calculating unit 3 provides the conditions at this time to the green-sand molding machine 1 so as to make the controlled amount for the molding machine 1 follow then in the molding process. Then green-sand molding machine 1 produces a mold. The produced mold has a desired charging of green sand in substantially all of the mold. In the first embodiment, surface-pressure 1 Ma of the squeezing is applied after compressed air is blown throughout the green sand.

Figure 5:
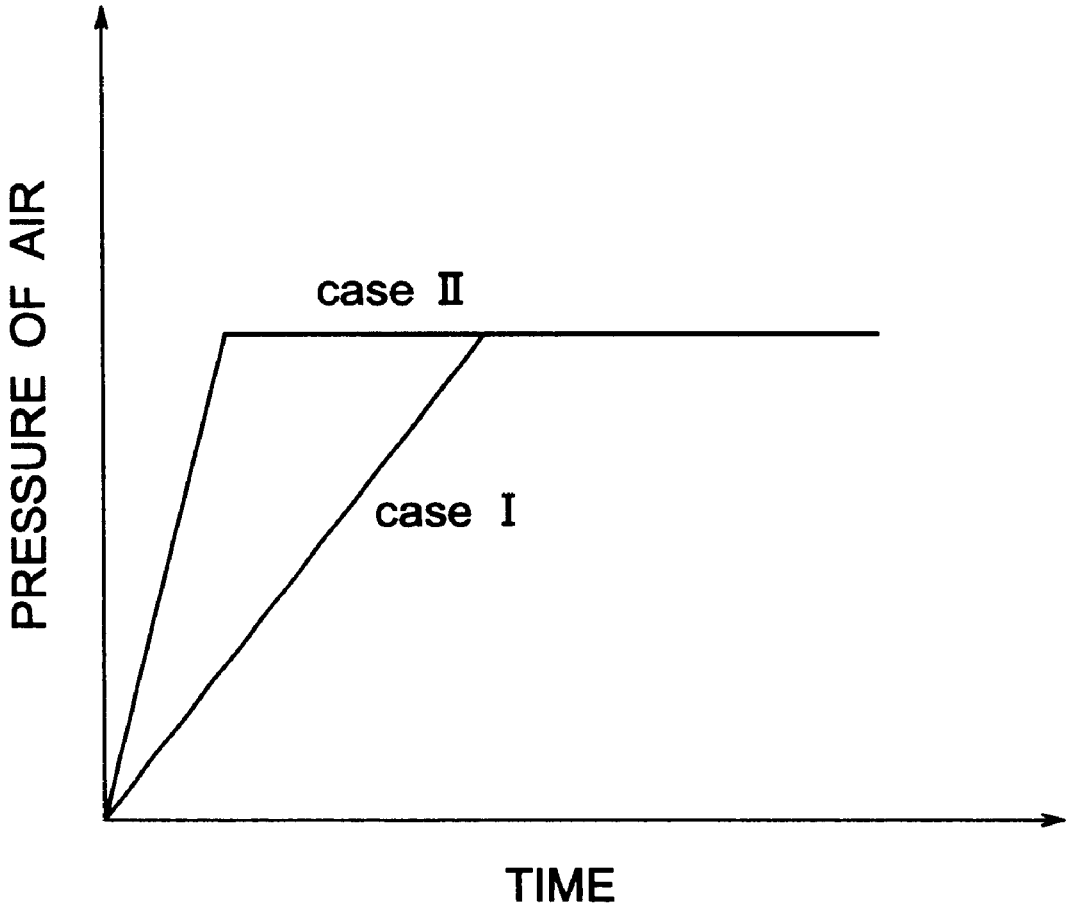
FIG. 5 shows a simulation of an anticipated change in pressure on the upper end of the green-sand layer during the air flow-applying-type molding process in the first embodiment.
Figure 6:
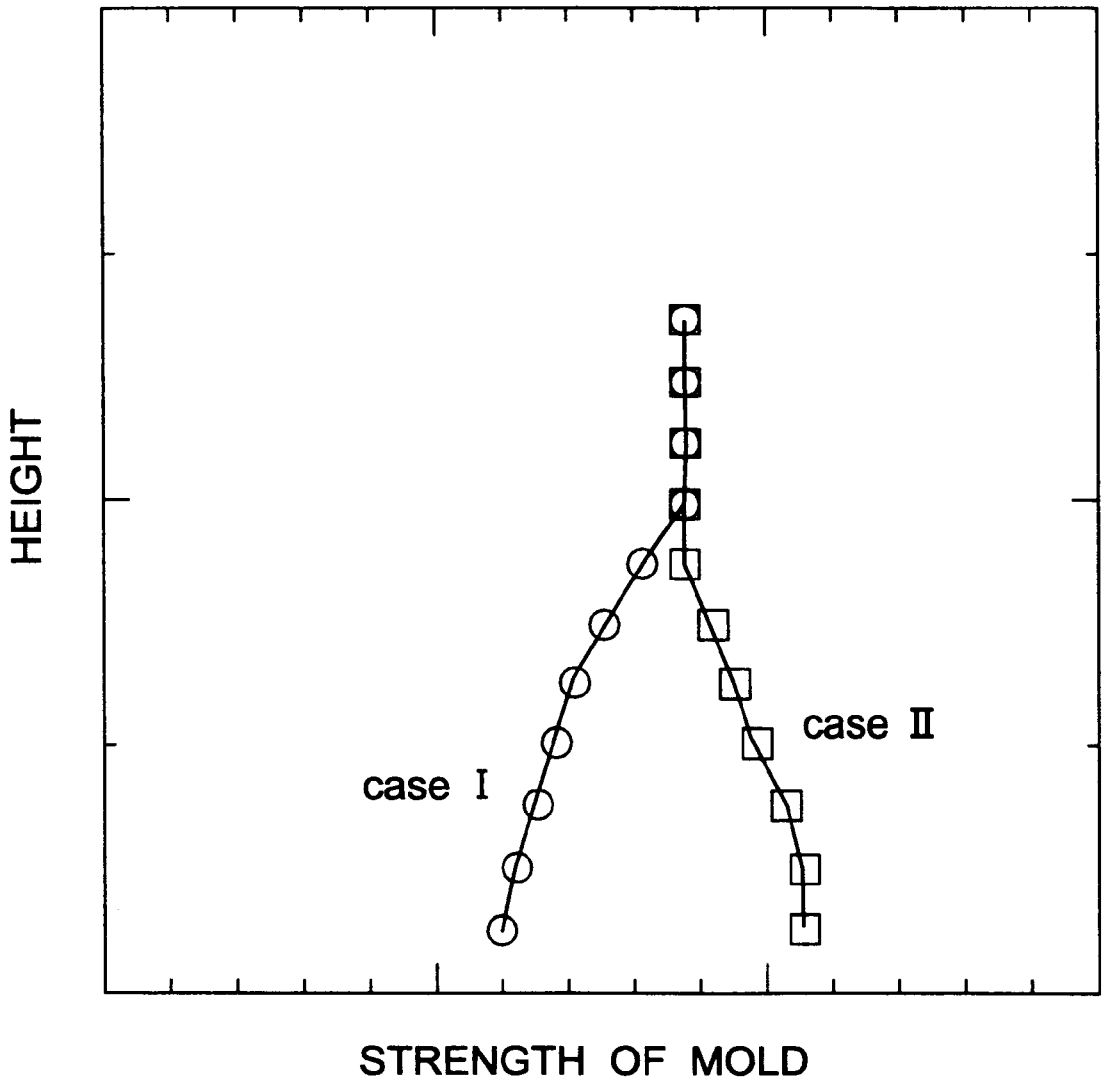
FIG. 6 shows a simulation of an anticipated distribution of the strength of the green-sand mold along the centerline thereof for the first embodiment.
Figure 7:
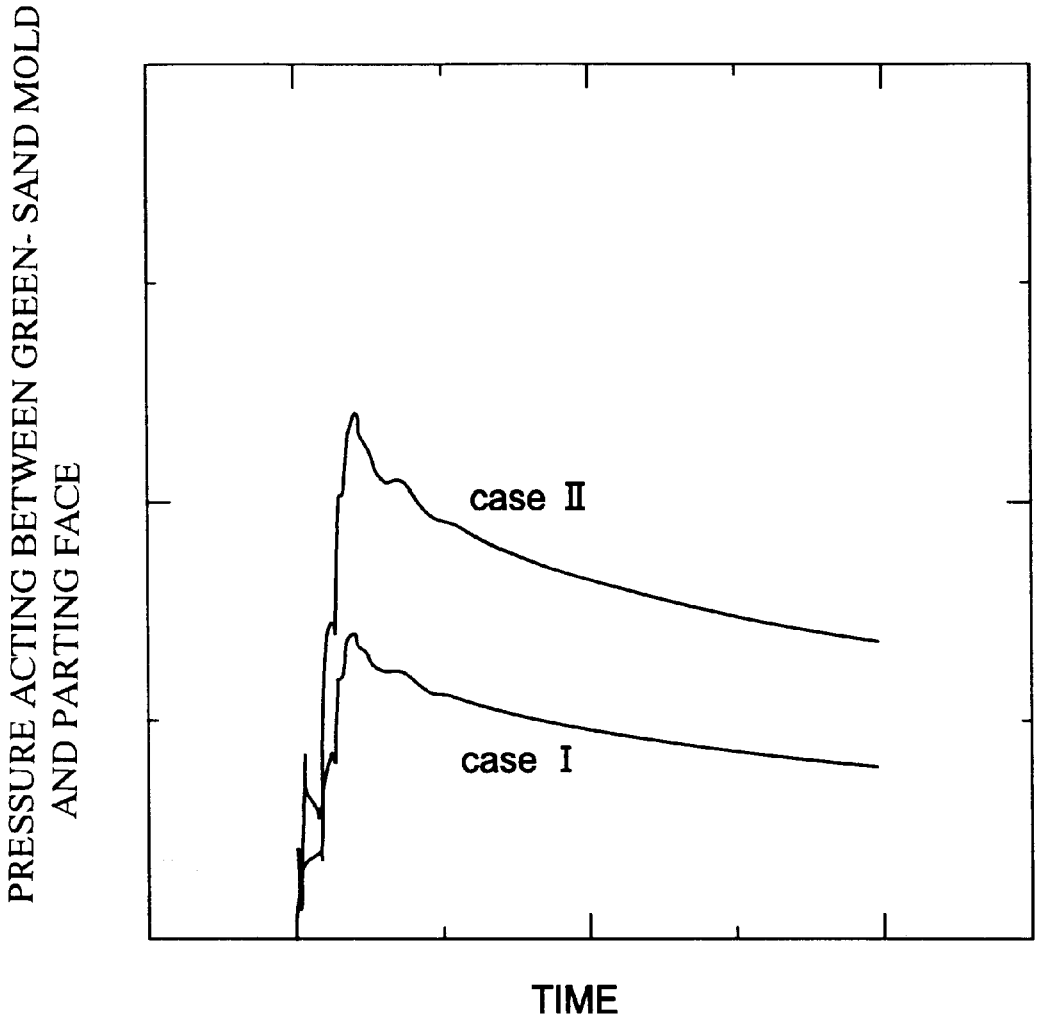
FIG. 7 shows a simulation of an anticipated pressure acting on the parting face from the green-sand mold during the air flow-applying-type molding process in the first embodiment.

FIGS. 5, 6, and 7 show simulations of the parts of the above steps for two different conditions, which are indicated as cases I and II. FIG. 5 shows a change in pressure on the upper end of the green-sand layer during the air flow-applying-type molding process. FIG. 6 shows a distribution of the strength of the green-sand mold along the centerline of it. FIG. 7 shows the pressure acting between the green-sand mold and a parting face during the air flow-applying-type molding process.

As can be seen from FIGS. 5, 6, and 7, the conditions of case II give better results and thus are more appropriate than the conditions of case I.

Figure 8:
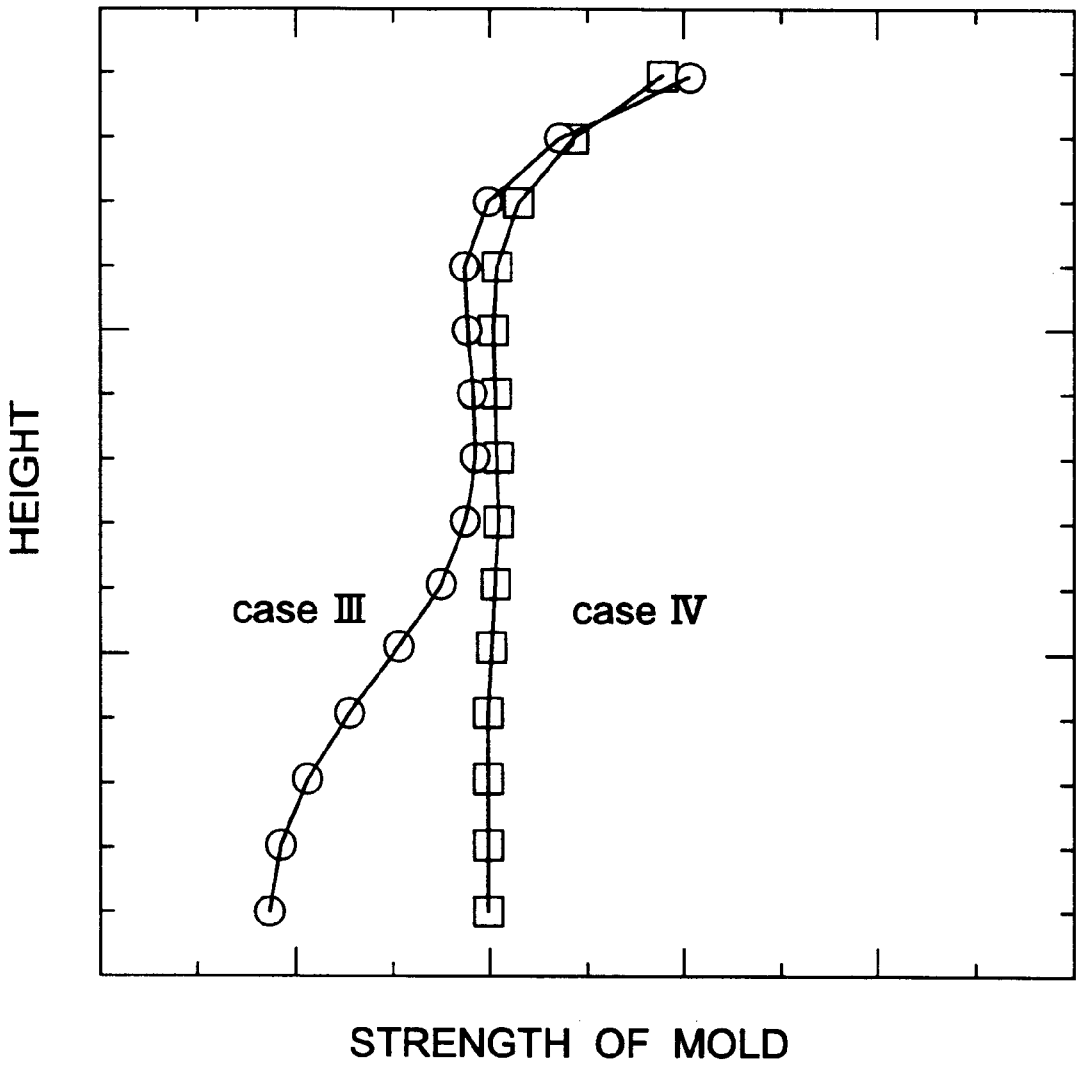
FIG. 8 shows a simulation of an anticipated distribution of the strength of the green-sand mold along the centerline thereof for the blow-type molding process in the second embodiment.

In reference to FIG. 8, the second embodiment is now explained. The second embodiment is also carried out as shown by the flowchart of FIG. 1 and system 10 of FIG. 2, but uses a blow-type mold process instead of the pressurized-air-applying-type of mold process in the first embodiment previously described. For pressures of compressed air for blowing in the second embodiment, 0.3 Mpa in case IV, and 0.5 Mpa in case V, are entered in the computer system 20. Similar to the first embodiment, surface-pressure 1 Ma of the squeezing is applied after air is blown throughout the green sand.

FIG. 8 shows a simulation of an anticipated distribution of the strength of the green-sand mold along the centerline of it as a simulation of the parts of the steps of the second embodiment. As can be seen from FIG. 8, the blow pressure of 0.5 Mpa of case IV gives better results, and thus is more appropriate, than the blow pressure of 0.3 Mpa of case V.

With the second embodiment, the produced mold from the green-sand molding machine has a desired charging of green sand in substantially all of the mold.

The present invention has been described in terms of specific embodiments incorporating details to facilitate the understanding of principles of the construction and operation of the invention. Such a reference herein to specific embodiments, and the details thereof, is not intended to limit the scope of the claims appended hereto. It will be apparent to those skilled in the art that modifications may be made in the embodiment chosen for illustration without departing from the sprit and scope of the invention.

What is claimed is:

1. A method of operating a green-sand molding machine with the aid of a computer, said green-sand molding machine including a pattern plate, to compact green sand fed into a green-sand mold by applying pressure of squeezing to said green sand under a green-sand molding process to be carried out by said green-sand molding machine, said method comprising the steps of:

(a) providing said computer with data for said green-sand molding process to be carried out by said green-sand molding machine, a design condition of said pattern plate, physical properties of said green sand, and said applied pressure of squeezing;

(b) calculating by said computer a charging of green sand in said green-sand mold based on said data before said green-sand mold has been actually produced;

(c) repeating said step (b) until a desired value for at least one of strength, porosity, and internal stress of said green-sand mold to be molded is obtained, while the applied pressure for squeezing is changed; and (d) operating said green-sand molding machine based on the result of said calculated charging of green sand in said green-sand mold so as to make a controlled amount for said green-sand molding wherein the calculating step (b) includes calculating movement of sand particles contained in said green sand and further wherein said steps (a) and (b) are repeated until said sand particles that are contained in said green sand stop moving.

2. The method of claim 1, wherein said green-sand molding process is a molding process carried out by at least one of a process type of a jolt squeezing, pressurized air, air blowing, and air impulses.

3. The method of claim 1, wherein said pattern plate includes a vent plug and a pocket, and wherein said design condition of said pattern plate includes at least one of a location of said vent plug, the number of said vent plugs, the shape of said pocket, and the height of said pocket.

4. The method of claim 1, wherein said green-sand mold is a mold in which green sand is composed of silica sand as aggregates.

5. The method of claim 4, wherein said green sand is further composed as a binder.

6. The method of claim 5, wherein said binder is bentonite.

7. The method of claim 5, wherein said binder is oolite.

8. The method of claim 1, wherein said physical properties of said green sand include water content, compressive strength, and permeability.

9. The method of claim 1, wherein the calculating step (b) includes one of a finite element method, a finite volume method, a differential calculus, and a discrete element method.

* * * * *